US006486865B1

(12) United States Patent
Ishiyama

(10) Patent No.: US 6,486,865 B1
(45) Date of Patent: Nov. 26, 2002

(54) SEMICONDUCTOR DEVICE, IMAGE DISPLAY SYSTEM AND ELECTRONIC SYSTEM

(75) Inventor: Hisanobu Ishiyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/486,959

(22) PCT Filed: Jul. 5, 1999

(86) PCT No.: PCT/JP99/03642

§ 371 (c)(1),
(2), (4) Date: Jun. 5, 2000

(87) PCT Pub. No.: WO00/02189

PCT Pub. Date: Jan. 13, 2000

(30) Foreign Application Priority Data

Jul. 3, 1998 (JP) ..... 10-189424

(51) Int. Cl.[7] ..... G09G 3/36
(52) U.S. Cl. ..... 345/98; 345/684; 345/211
(58) Field of Search ..... 345/682, 684, 345/686, 688, 784, 785, 786, 788, 792, 830, 28, 87, 973, 88, 89, 98, 99, 100, 211, 212, 213, 204, 205

(56) References Cited

U.S. PATENT DOCUMENTS 4,611,202 A * 9/1986 DiNitto et al. ..... 345/686
5,854,629 A * 12/1998 Redpath ..... 345/830

FOREIGN PATENT DOCUMENTS

| | | |
|---|---|---|
| JP | 55-147670 | 11/1980 |
| JP | 60-55389 | 3/1985 |
| JP | 60-73573 | 4/1985 |
| JP | 60-102689 | 6/1985 |
| JP | 63-204294 | 8/1988 |
| JP | 2-94 | 1/1990 |
| JP | WO 00/02189 | 1/2000 |

* cited by examiner

*Primary Examiner*—Xiao Wu
(74) *Attorney, Agent, or Firm*—Hogan & Hartson, LLP

(57) ABSTRACT

An image display system includes a register for storing a display address of a fixed display area, a register for storing an address of a scroll area, a register for storing an address from which scrolling is to be started, etc. By properly setting the addresses stored in those registers in counters for counting a display address of a display RAM 131, it is possible to count the display address while freely skipping addresses and to scroll a part of a screen. Therefore, the number of accesses made from an MPU 11 to the display RAM 131 is much lessened and power consumption can be greatly reduced in comparison with the case of rewriting data in the display RAM 131 for scrolling. By preparing a memory that has a larger capacity than required for displaying a full screen image, when an interrupt or the like is applied to the MPU 11 during scrolling, the data in the course of the scrolling is avoided from appearing on the screen.

18 Claims, 12 Drawing Sheets

SEMICONDUCTOR DEVICE, IMAGE DISPLAY SYSTEM AND ELECTRONIC SYSTEM

BACKGROUND OF THE INVENTION

1. Field of the Invention

The present invention relates to a semiconductor device used for efficiently changing the position of display data displayed on a display device, an image display system using the semiconductor device, and an electronic system using the image display system. More particularly, the present invention relates to the sequence of supplying display data, which is stored in a display RAM (Random Access Memory), to an image display system.

2. Related Art

For displaying data on a liquid crystal display (hereinafter referred to as an "LCD") which serves as a display device, a semiconductor device called an LCD driver is employed. There are two types of LCD drivers, i.e., a segment driver (hereinafter referred to as an "X driver") for driving data electrodes of the LCD, and a common driver (hereinafter referred to as a "Y driver") for driving scanning electrodes of the LCD. The X driver is a circuit for receiving display data to be displayed on the LCD from a display RAM through a circuit called a display controller, and converting the received data into a voltage required for driving the LCD. The Y driver is a circuit for receiving, through the display controller, data to select a line in which a data signal supplied from the X driver is to be written, and converting a voltage for selection/non-selection into the voltage required for driving the LCD. Usually, the selected line is scanned by a line-at-a-time scheme.

With advances in the semiconductor manufacturing technology and the circuit technology, it has recently become possible to integrate an X driver, a display RAM and a display controller into one IC, or further integrate a Y driver and a display power supply circuit for an LCD as well. As a result, a reduction in the number of chips used in a display system and a reduction in power consumed by the display system are promoted.

FIG. 2 is a schematic block diagram of a conventional image display system.

The conventional image display system includes a microprocessor (hereinafter referred to as an "MPU") 1. The MPU 1 is constituted by a central processing unit, and has the function of generating a signal to write display data, which is to be displayed on an LCD, in a display RAM. An oscillator 2 has the function of generating a reference clock required for displaying data on the LCD. A RAM built-in X driver 3 is a one-chip unit incorporating a display RAM 31, a display controller which is, though not denoted in FIG. 2, made up of an MPU logic 33 and a display logic 34, and an X driver 32. A Y driver 4 is a circuit for receiving, through the display controller, data to select a line in which a data signal supplied from the X driver 32 is to be written, and converting a voltage for selection/non-selection into a voltage required for driving the LCD. A display power supply 5 has the function of generating a voltage required for displaying data on the LCD. LCD panels 61, 62 are each the same panel, but represent the cases displaying different screen images. The display RAM 31 is constituted by a dual port RAM that interfaces with the MPU and the display system in asynchronous relation. The X driver 32 is a circuit for converting the display data read out of the display RAM 31 into a voltage required for displaying data on the LCD.

The MPU logic circuit 33 has the function of performing processing related to the MPU 1 such as processing of commands sent from the MPU 1 and control of the display data to be read out of and written in the display RAM 31. The display logic circuit 34 has the function of performing control related to display such as control of the operation of reading the display data out of the display RAM 31 and supplying the read-out data to the X driver 32 and control of the Y driver 4. A memory area 301 serves as an area for storing the display data. An MPU read/write circuit 302 is a circuit for performing control of reading/writing made on the memory area 301. An MPU row address 303 is a decoder for indicating an address of the memory area 301 in the Y (row) direction in the reading/writing mode of the MPU. An MPU column address 304 is a decoder for outputting an address of the memory area 301 in the X (column) direction in the reading/writing mode of the MPU. A display address 305 is a decoder for reading the display data, which is to be supplied to the X driver 32, from among the display data stored in the memory area 301.

The LCD panel 61 has a display capacity of 320×240 dots; namely, it has 240 lines of common electrodes on the left side of the panel and 320 lines of segment electrodes on the upper side thereof. The display RAM 31 incorporated in the RAM built-in X driver 3 has the same display capacity as the LCD panel 61, i.e., 320×240 bits. The MPU column address 304 of the display RAM 31 includes 320 addresses corresponding to the number of dots in the X direction of the LCD panel 61. Because of 8-bit simultaneous writing, the MPU row address 303 of the display RAM 31 includes 30 addresses corresponding to a result of dividing 240, i.e., the number of dots in the Y direction of the LCD panel 61, by 8. The MPU 1 can write data, which is to be displayed, at any desired position in the display RAM 31 through the MPU logic circuit 33 and the MPU read/write circuit 302 by designating any desired addresses to the MPU column address 304 and the MPU row address 363 through the MPU logic circuit 33. One bit of the display data corresponds to one dot for display in the LCD panel 61. If the display data is "0", the predetermined dot in the LCD panel 61 corresponding to that display data is displayed white, and if the display data is "1", it is displayed black.

The display address 305 includes 240 addresses corresponding to the number of dots in the Y direction of the LCD panel 61. The display logic circuit 34 designates any one of the display addresses "0"–"239". When the display address is designated, the display RAM 31 outputs data of 320 bits corresponding to the number of dots in the X direction of the LCD panel 61, and supplies the data to the X driver 32. The X driver 32 converts the received display data into a voltage required for driving the LCD panel 61, and supplies the voltage to the LCD panel 61 for driving the same.

FIG. 3 is a time chart of signals at respective points for explaining the operation of the image display system of FIG. 2. In FIG. 3, the vertical axis represents a logical level and the horizontal axis represents time. The operation of FIG. 2 will be described below with reference to FIG. 3.

A signal 401 is a reset (RES) signal. A signal 402 is a reference clock DCLK supplied from the oscillator 2. Signals 403, 412 are each an output of a not-shown address counter included in the display logic circuit 34. Signals 404, 413 are each X driver data given by the data in the display RAM 31 that is taken in by the X driver 32 at a fall of the reference clock DCLK. A signal 405 is a selection signal YDATA supplied to the Y driver 4. Signals 406–411 are selected data transferred by a 240-step shift register (not shown) in the Y driver 4.

As indicated by the signal 403, the output of the not-shown address counter included in the display logic circuit 34 is initialized to "0" with the rise edge of the reset signal RES. After that, the output of the not-shown address counter is counted up with the rise edge of the reference clock DCLK 402, and is returned to "0" upon the count reaching "239" as indicated by the signal 403. The signal 403, which is an output signal of the address counter, is supplied to the display address 305, whereby the display address is designated from "0" to "239" in sequence.

The YDATA 405 is a selection-signal supplied to the Y driver 4. "H" of the YDATA 405 corresponds to line selection and "L" corresponds to non-selection. The YDATA 405 turns to "H" from the rise edge of the reset signal RES to the rise edge of the next reference clock DCLK. After that, the YDATA 405 turns to "H" each time 240 pulses of the reference clock DCLK are outputted. The Y driver 4 takes in the YDATA with the fall edge of the reference clock DCLK and transfers the YDATA by the 240-step shift register. (not shown) in the Y driver 4. Outputs of respective registers of the 240-step shift register are issued as the signals 406–411 and provide data supplied to 240 terminals of the Y driver 4. The outputs of the respective registers are each converted into a voltage required for displaying data on liquid crystals, and are then supplied to the LCD panel 61 for driving the LCD panel 61. The data of the signal Y0 (406) is supplied to an uppermost terminal of the LCD panel 61 after being converted into a voltage required for displaying data on liquid crystals, and the data of the signal Y1 (407) is supplied to another terminal positioned adjacently under the uppermost terminal. Likewise, the data of the signal Y2 (408) is supplied to still another terminal positioned adjacently under the second uppermost terminal. In other words, one of the 240 lines of common electrodes is selected each time, and the selected electrode is scanned downward from the uppermost electrode.

The display address 305 of the display RAM 31 includes addresses assigned with "0"–"239" from an upper end to a lower end. As shown in FIG. 2, data "□", "○" and "Δ" are written by the MPU 1 in the memory area 301 throughout the display addresses "0"–"239". Those display data are each symbolically indicated, taking into account that a dot in the memory area 301 where "1" has been written is displayed black and a dot therein where "0" has been written is displayed white. In fact, the display data is electrically written in the memory area 301.

When the display address is initialized to "0" by the reset signal RES as indicated by the address counter output signal 403 in FIG. 3, the X driver 32 outputs the display data at the display address "0" to the segment electrodes with the fall edge of the next reference clock DCLK as indicated by the X driver data 404. At this time, the Y driver 4 is outputting the selection signal to the uppermost common electrode of the LCD panel 61 as indicated by the signal Y0 (406). Therefore, the data at the display address "0" is written and displayed in the uppermost line of the LCD panel 61. With the fall edge of the further next reference clock DCLK, the X driver 32 outputs the display data at the display address "1" to the segment electrodes as indicated by the X driver data 404. At this time, the Y driver 4 is outputting the selection signal to the second uppermost common electrode of the LCD panel 61 as indicated by the signal Y1 (407). Therefore, the data at the display address "1" is written and displayed in the second uppermost line of the LCD panel 61. Likewise, with the fall edge of the further next reference clock DCLK (402), the further next display data is written and displayed in the further next selected line. Thus, the data "□", "○" and "Δ" are written in the display RAM 31 at "0"–"239" of the display address, the display address is advanced while being counted up from "0" to "239", and the common electrodes are selected one by one from the uppermost side by a line-at-a-time scheme. Consequently, as shown in FIG. 2, the display data is now displayed on the LCD panel 61 from the upper side to the lower side in accordance with the order of the display addresses "0"–"239" of the display RAM 31.

Then, when the display address is initialized to, e.g., "120" by the reset signal RES (401) as indicated by the address counter output signal 412 in FIG. 3, the X driver 32 outputs the display data at the display address "120" to the segment electrodes with the fall edge of the next reference clock DCLK (402) as indicated by the X driver data (413). At this time, the Y driver 4 is outputting the selection signal to the uppermost common electrode of the LCD panel 62 as indicated by the signal Y0 (406). Therefore, the data at the display address "120" is written and displayed in the uppermost line of the LCD panel 62. With the fall edge of the further next reference clock DCLK (402), the X driver 32 outputs the display data at the display address "121" to the segment electrodes as indicated by the X driver data (413). At this time, the Y driver 4 is outputting the selection signal to the second uppermost common electrode of the LCD panel 62 as indicated by the signal Y1 (407). Therefore, the data at the display address "121" is written and displayed in the second uppermost line of the LCD panel 62. Likewise, with the fall edge of the further next reference clock DCLK (402), the further next display data is written and displayed in the further next selected line. Assume now that the data "□", "○" and "Δ" are written in the display RAM 31 at "0"–"239" of the display address. On the other hand, the display address is counted up from "120" to "239", returned to "0" upon reaching "239", and counted up again from "0" to increase one by one, and the common electrodes are selected one by one from the uppermost side by a line-at-a-time scheme. Consequently, as shown in FIG. 2, the data in the lower side (i.e., the display addresses "120"–"239") are now displayed in the upper side (1–120 lines from the uppermost) of the LCD panel 62, and the data in the upper side (i.e., the display addresses "0"–"119") are now displayed in the lower side (121–240 lines from the uppermost) of the LCD panel 62.

The display address of the address counter (not shown) included in the display logic circuit 34 is set to a predetermined initial value at the timing of the reset signal RES (401). The MPU 1 can freely set the initial value of the display address through the MPU logic circuit 33. Accordingly, the MPU 1 can scroll a screen vertically just by writing, in the address counter not shown in FIG. 3, the initial value of the display address which is to be displayed at the uppermost end of the LCD panel 61, without rewriting the display data in the display RAM 31.

With the above construction wherein the address counter returns to "0" after counting up to "239", however, a full screen of the LCD panel 61 is scrolled. In case, for example, that an image which is not to be scrolled is displayed in the upper or lower side of an active area of the LCD panel 61 and a part of the screen is to be scrolled, the display data in an area of the display RAM 31, which is to be scrolled, must be rewritten from the MPU 1 through the MPU logic circuit 33. In such a case, the number of accesses from the MPU 1 to the RAM built-in X driver 3 is much increased and power consumption of the display system is increased correspondingly. Further, the following problem has been experienced. For example, if another interrupt signal is applied to the MPU 1 during rewriting of the display data to be scrolled and the rewriting of the display data is suspended halfway, the display data under the rewriting in the course of scrolling appears on the LCD panel 61.

SUMMARY OF THE INVENTION

In view of the problems described above, an object of the present invention is to provide a semiconductor device, an image display system, and an electronic system employing them, which have succeeded in overcoming the above-described problems.

To achieve the above object, according to a first aspect of the present invention, there is provided a semiconductor device comprising a memory for storing display data, and a voltage converting unit for converting a logical voltage based on the display data into a driving voltage for driving a display device, the display data being read out of the memory in accordance with a reference clock, the driving voltage being converted corresponding to the read-out display data and being supplied to the display device, wherein the semiconductor device further comprises a counting unit for counting an address of the memory and registers for storing any desired addresses, and the sequence of reading the display data stored in the memory is optionally set in accordance with the contents of the registers.

According to a second aspect of the present invention, there is provided a semiconductor device comprising a memory for storing display data, a display controller for reading the display data out of the memory in accordance with a reference clock and supplying the read-out display data to a voltage converting unit, and the voltage converting unit for converting a logical voltage based on the supplied display data into a driving voltage for driving a display device and supplying the driving voltage to the display device, wherein the display controller comprises a counting unit for counting an address of the memory and registers for storing any desired addresses, and the sequence of reading the display data stored in the memory is optionally set in accordance with the contents of the registers.

According to a third aspect of the present invention, the image display system includes at least one fixed display area and at least one display area capable of being scrolled.

With the construction set forth above, since the present invention includes the registers for storing any desired addresses, the sequence of designating the display address of the memory for storing the display data, which is supplied to the display device, is set such that after counting up from one desired address to another desired address, counting is skipped to still another desired address and then continued to further another desired address. A displayed image is therefore partly scrolled without rewriting the data in the memory. As a result, the semiconductor device of the present invention is suitably employed in an image display system and an electronic system.

PREFERRED EMBODIMENTS OF THE INVENTION

First Embodiment

A first embodiment will be described with reference to the drawings.

Figure 1:
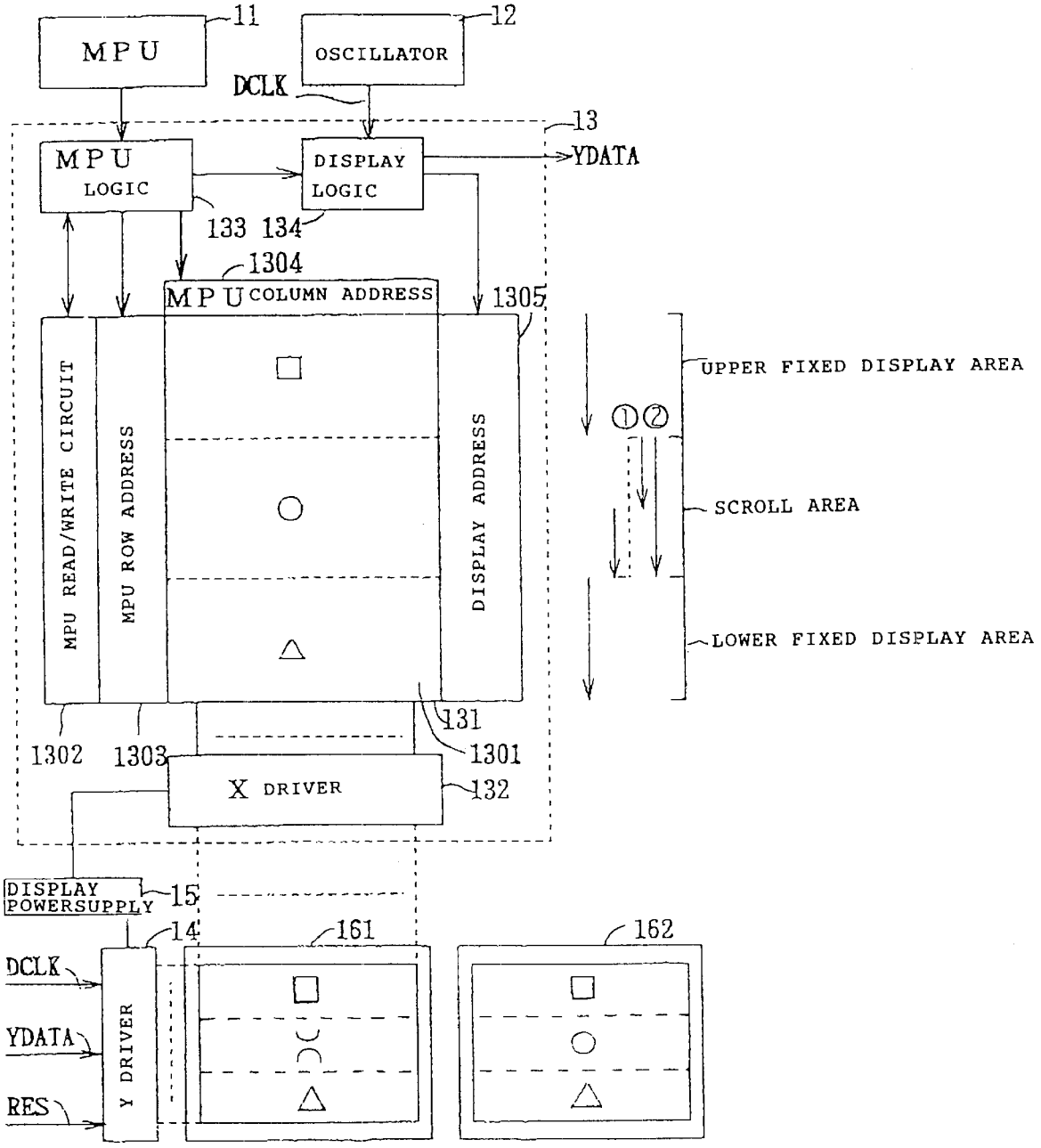
FIG. 1 is a block diagram of an image display system according to a first embodiment of the present invention.
Figure 2:
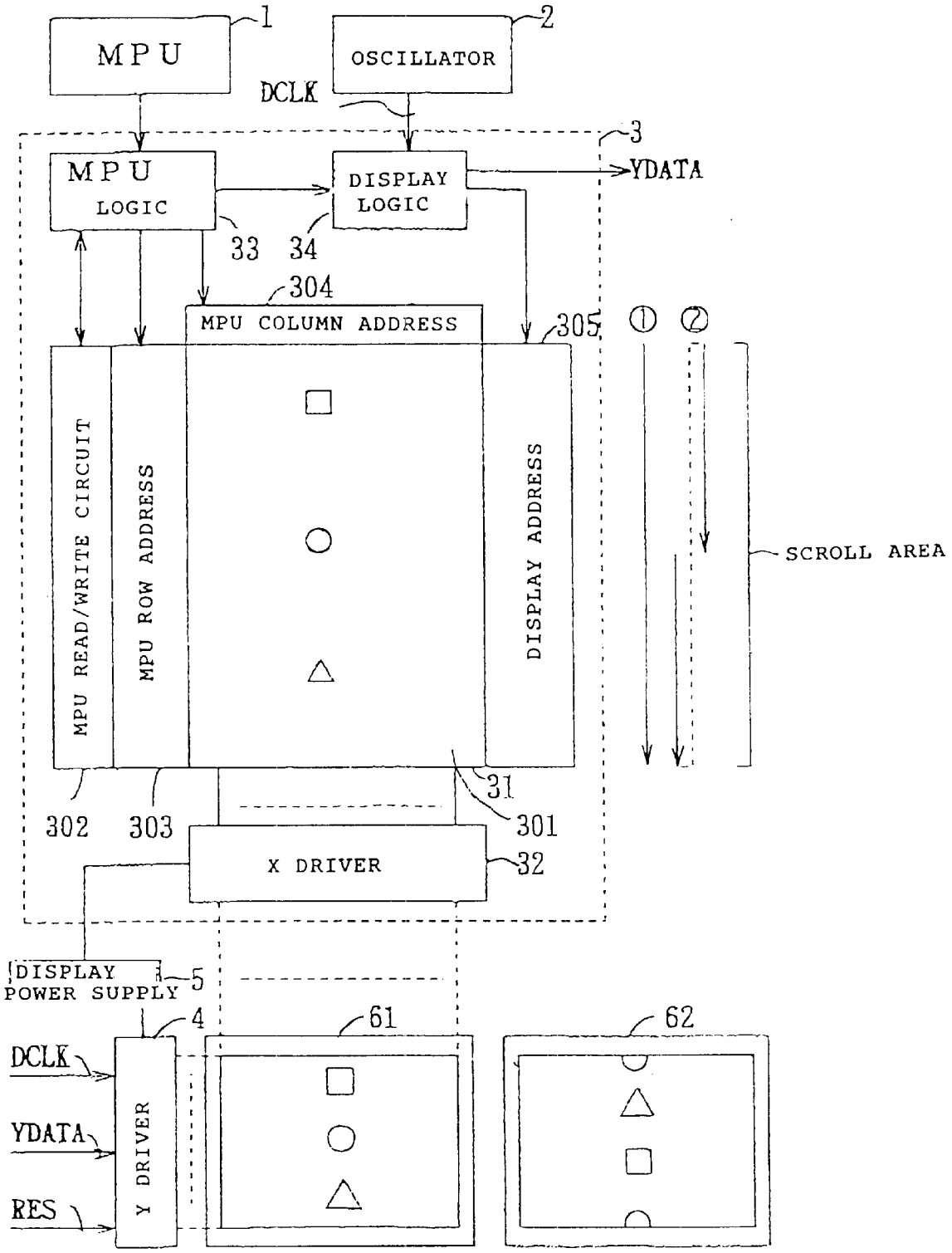
FIG. 2 is a block diagram of a conventional image display system.
Figure 3:
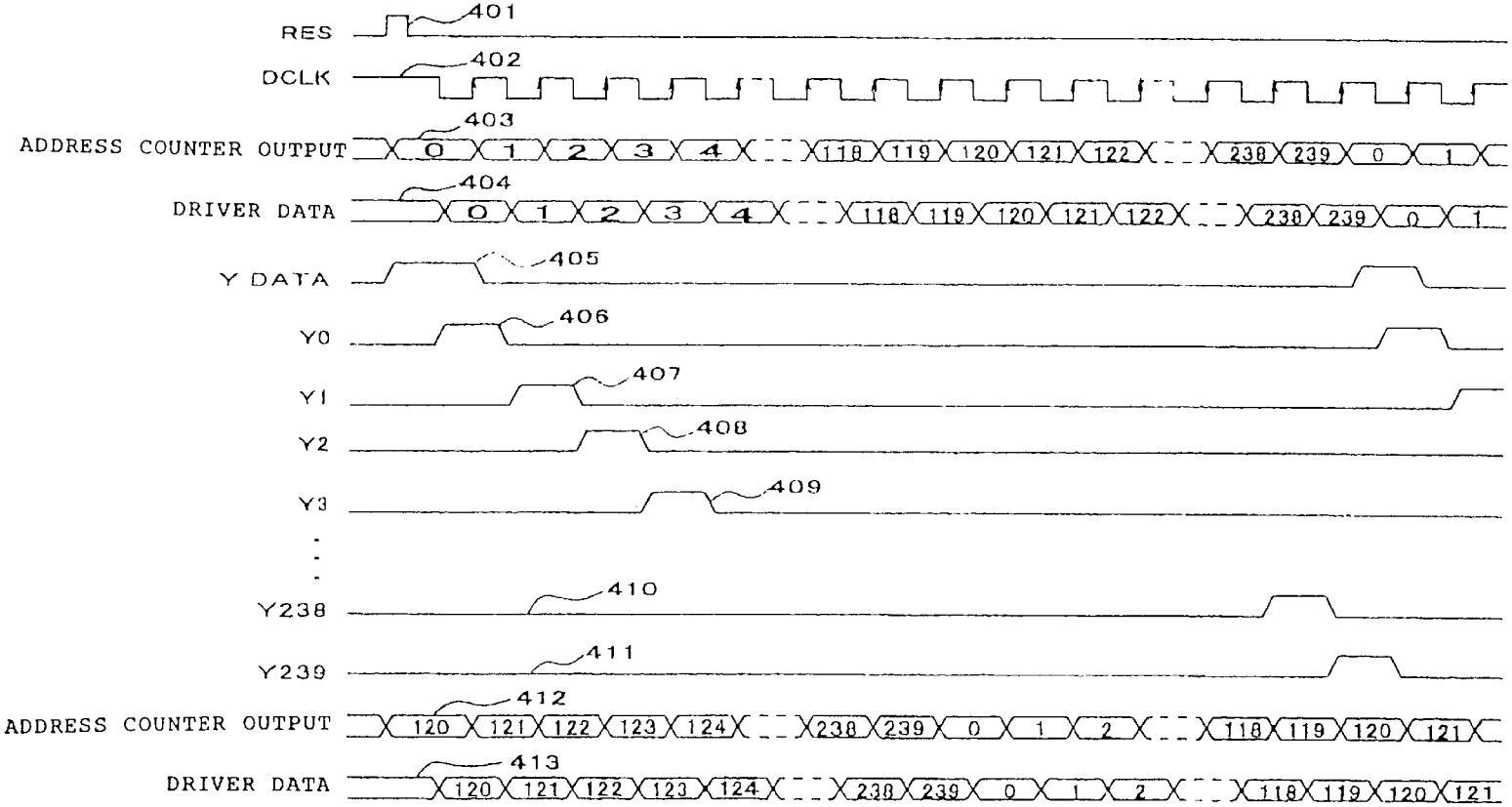
FIG. 3 is a time chart for FIG. 2.

FIG. 1 is a schematic block diagram of an image display system in accordance with a first embodiment of the present invention.

The image display system of this embodiment includes an MPU 11. The MPU 11 is constituted by a central processing unit, and has the function of generating a signal to write display data, which is to be displayed on an LCD, in a display RAM. An oscillator 12 has the function of generating a reference clock required for displaying data on the LCD. A RAM built-in X driver 13 is a one-chip unit incorporating a display RAM 131, a display controller which is, though not denoted in FIG. 1, made up of an MPU logic 133 and a display logic 134, and an X driver 132. A Y driver 14 is a circuit for receiving, through the display controller, data to select a line in which a data signal supplied from the X driver 32 is to be written, and converting a voltage for selection/non-selection into a voltage required for driving the LCD. A display power supply 15 has the function of generating a voltage required for displaying data on the LCD. LCD panels 161, 162 are each the same panel, but represent the cases displaying different screen images. The display RAM 131 is constituted by a dual port RAM that interfaces with the MPU and the display system in asynchronous relation. The X driver 132 is a circuit for converting the display data read out of the display RAM 131 into a voltage required for displaying data on the LCD. The MPU logic circuit 133 has the function of performing processing related to the MPU 11 such as processing of commands sent from the MPU 11 and control of the display data to be read out of and written in the display RAM 131. The display logic circuit 134 has the function of performing control related to display such as control of the operation of reading the display data out of the display RAM 131 and supplying the read-out data to the X driver 132 and control of the Y driver 14. A memory area 1301 serves as an area for storing the display data. An MPU read/write circuit 1302 is a circuit for performing control of reading/writing made on the memory area 1301. An MPU row address 1303 is a decoder for indicating an address of the memory area 1301 in the Y (row) direction in the reading/writing mode of the MPU. An MPU column address 1304 is a decoder for indicating an address of the memory area 1301 in the X (column) direction in the reading/writing mode of the MPU. A display address 1305 is a decoder for reading the display data, which is to be supplied to the X driver 132, from among the display data stored in the memory area 1301.

The LCD panel 161 has a display capacity of 320×240 dots; namely, it has 240 lines of common electrodes on the left side of the panel and 320 lines of segment electrodes on the upper side thereof. The display RAM 131 incorporated in the RAM built-in X driver 13 has the same display capacity as the LCD panel 161, i.e., 320×240 bits. The MPU column address 1304 of the display RAM 131 includes 320 addresses corresponding to the number of dots in the X direction of the LCD panel 161. Because of 8-bit simultaneous writing, the MPU row address 1303 of the display RAM 131 includes 30 addresses corresponding to a result of dividing 240, i.e., the number of dots in the Y direction of the LCD panel 161, by 8.

The MPU 11 can write data, which is to be displayed, at any desired position in the display RAM 131 through the MPU logic circuit 133 and the MPU read/write circuit 1302 by designating any desired addresses to the MPU column address 1304 and the MPU row address 1303 through the MPU logic circuit 133. One bit of the display data corresponds to one dot for display in the LCD panel 161. If the display data is "0", the predetermined dot in the LCD panel 161 corresponding to that display data is displayed white, and if the display data is "1", it is displayed black.

The display address 1305 includes 240 addresses corresponding to the number of dots in the Y direction of the LCD panel 161. The display logic circuit 134 designates any one of the display addresses "0"–"239". When the display address is designated, the display RAM 131 outputs data of 320 bits corresponding to the number of dots in the X direction of the LCD panel 161, and supplies the data to the X driver 132. The X driver 132 converts the received display data into a voltage required for driving the LCD panel 161, and supplies the voltage to the LCD panel 161 for driving the same.

Figure 4:
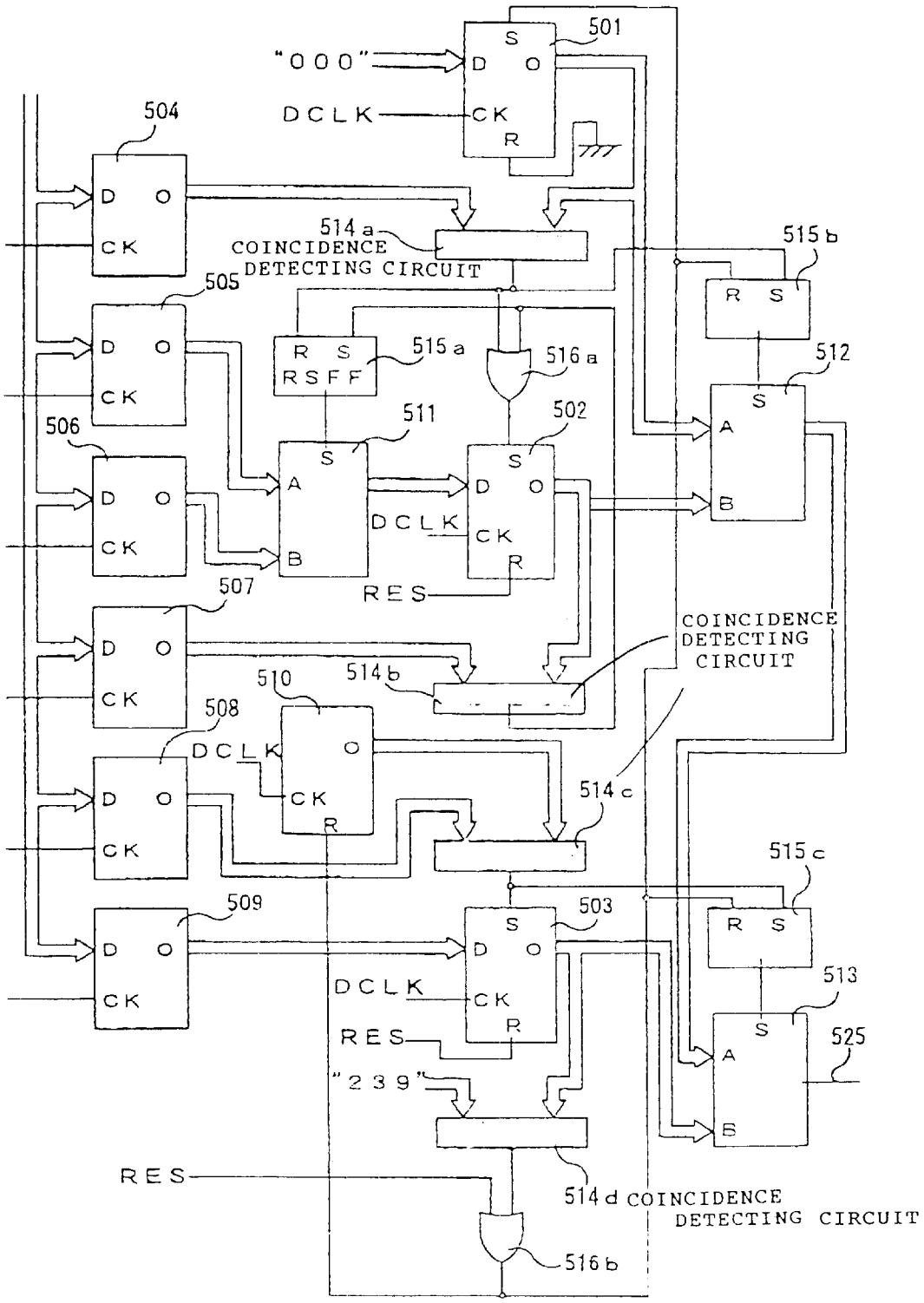
FIG. 4 is a circuit diagram of a display logic circuit 134 in FIG. 1.

FIG. 4 is a circuit diagram of the display logic circuit 134 in FIG. 1.

In the display logic circuit 134, counters 501–503 are each an 8-bit address counter with set and reset terminals. Registers 504–509 each store an 8-bit address. A counter 510 is an 8-bit counter with a reset terminal. Selectors 511–513 each function to select one of 8-bit, 2-line data A and data B. Specifically, each selector selects data A when "L" is inputted to a select terminal S, and selects data B when "H" is inputted to the select terminal S. A coincidence-detecting circuit 514 compares sets of 8-bit, 2-line data. A set/reset flip-flop (hereinafter referred to as an "RSFF") 515 outputs "L" when an "H" pulse is inputted to a reset terminal R, and outputs "H" when an "H" pulse is inputted to a set terminal S. An OR gate 516 is a circuit for outputting theological sum of two input signals. A signal 525 is an address counter output.

Figure 5:
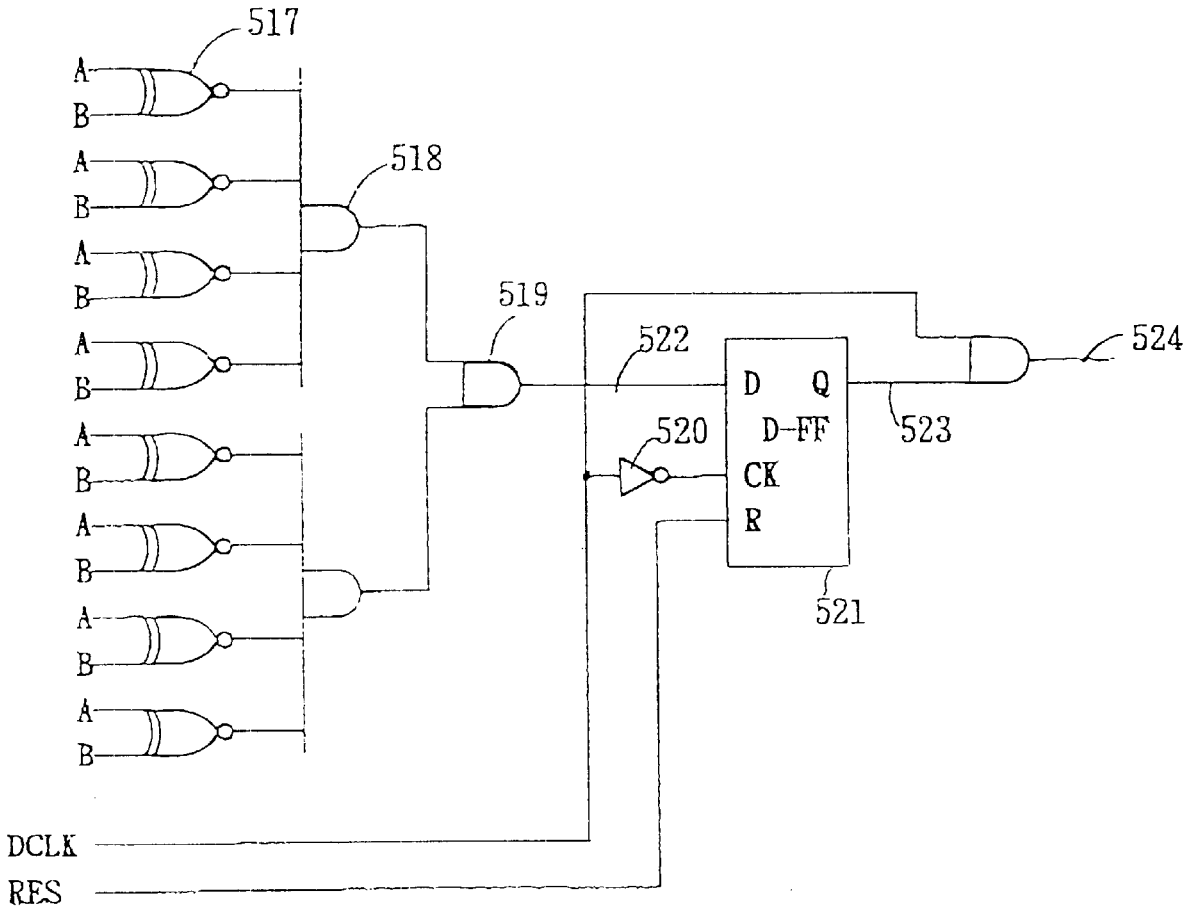
FIG. 5 is a circuit diagram of a coincidence detecting circuit 514 in FIG. 4.

FIG. 5 is a circuit diagram showing one example of the coincidence-detecting circuit 514 in FIG. 4.

In the coincidence-detecting circuit 514, numeral 517 denotes an exclusive NOR circuit (hereinafter referred to as an "EXN"), numeral 518 denotes a 4-input AND circuit, numeral 519 denotes a 2-input AND circuit, numeral 520 denotes an inverter, numeral 521 denotes a delay flip-flop (hereinafter referred to as a "D-FF"), numeral 522 denotes an 8-bit comparison output, numeral 523 denotes an output of the D-FF, and numeral 524 denotes a coincidence-detected output.

Figure 6:
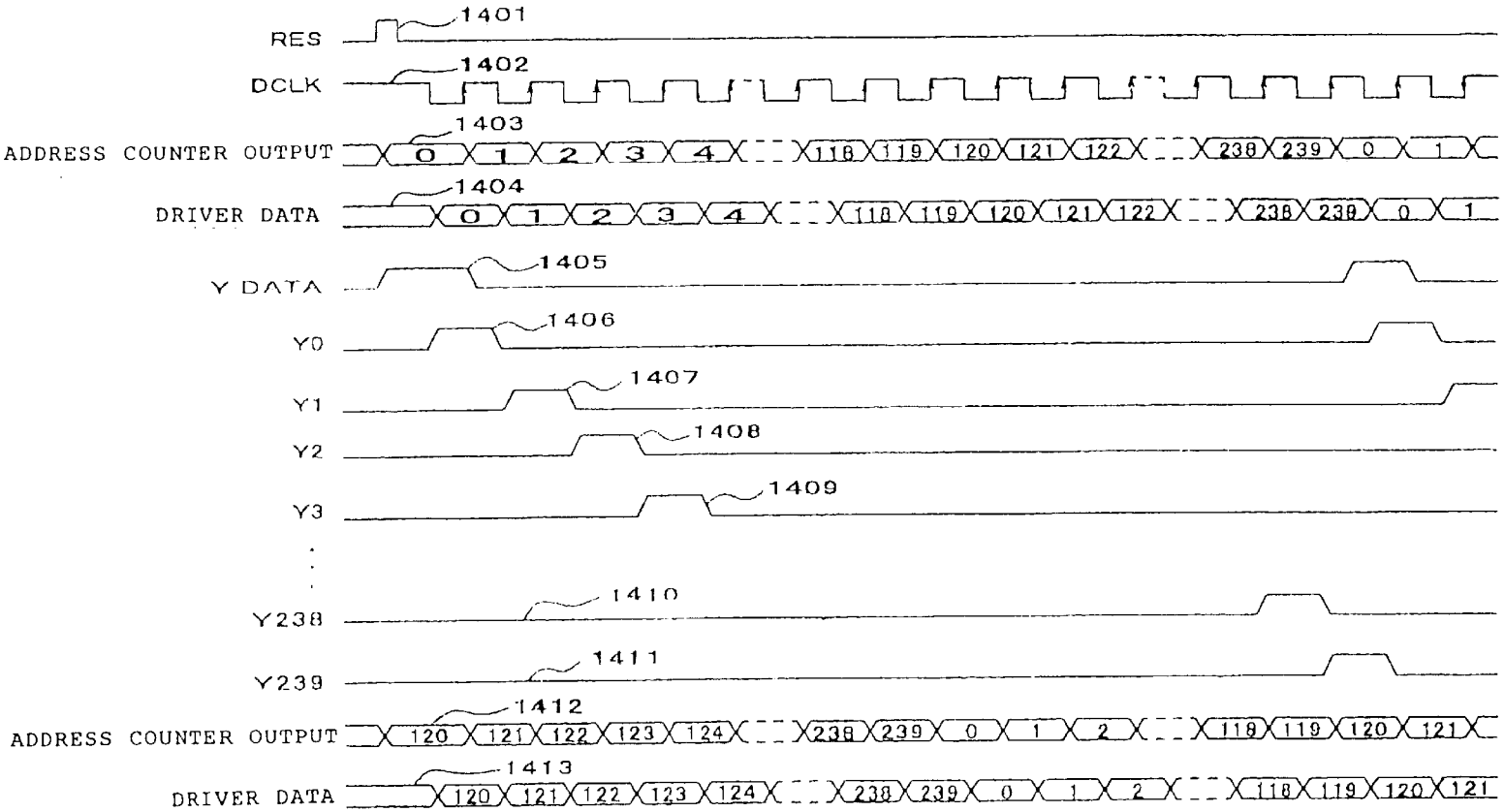
FIG. 6 is a time chart for FIG. 1.
Figure 7:
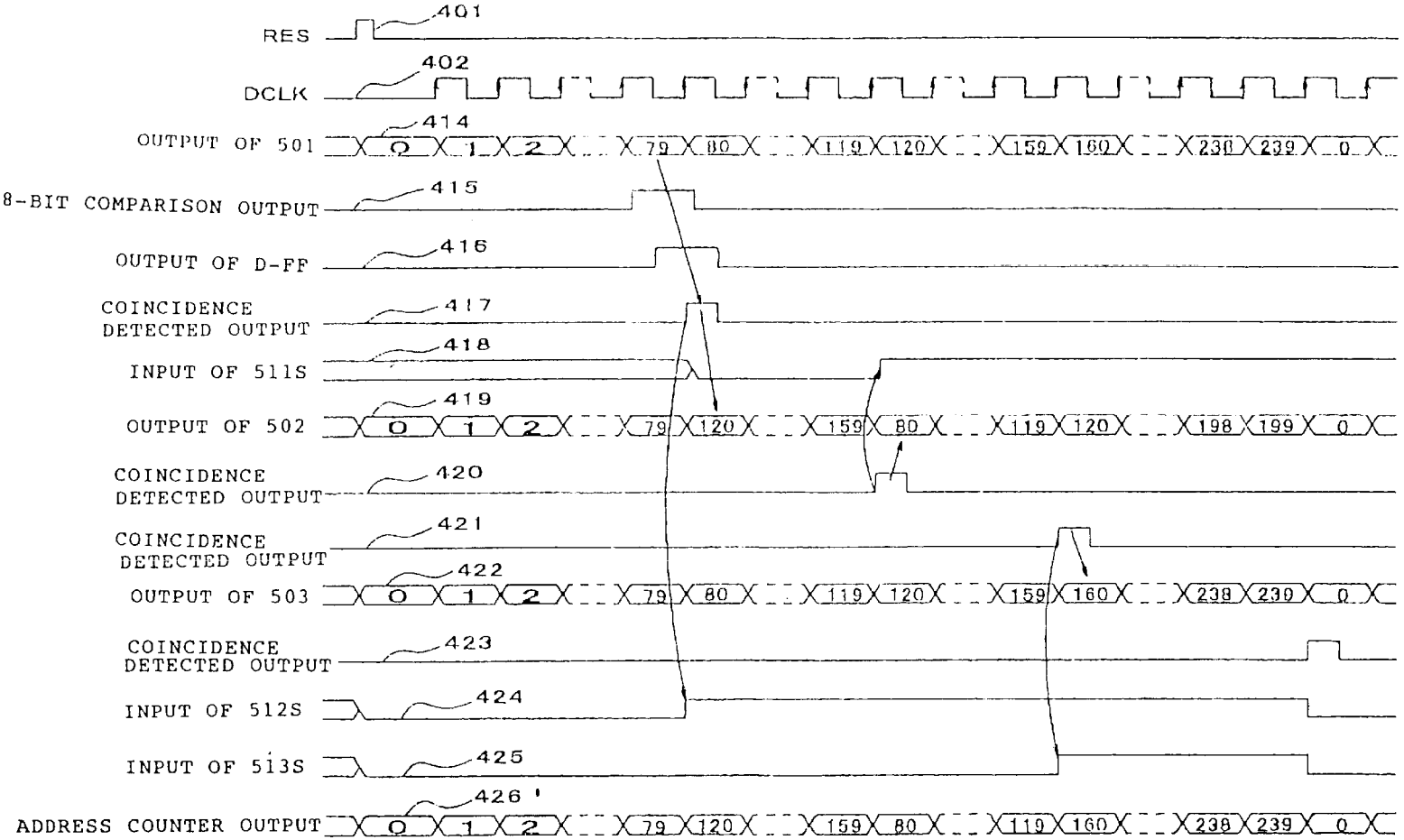
FIG. 7 is a time chart for FIG. 4.

FIG. 6 is a time chart of signals at respective points for explaining the operation of FIG. 1, and FIG. 7 is a time chart of signals at respective points for explaining the operation of FIG. 4. In each time chart, the vertical axis represents a logical level and the horizontal axis represents time. The operation of the image display system shown in FIG. 1 will be described with reference to FIGS. 6, 7 and 4.

A signal 1401 is a reset (RES) signal, a signal 1402 is a reference clock DCLK supplied from the oscillator 12, signals 1403, 1412 are each an output of a not-shown address counter included in the display logic circuit 134, signals 1404, 1413 are each X driver data given by the data in the display RAM 131 that is taken in by the X driver 132 at a fall of the reference clock DCLK, a signal 1405 is a selection signal YDATA supplied to the Y driver 14, and signals 1406–1411 are selected data transferred by a 240-step shift register (not shown) in the Y driver 14.

The selection signal YDATA (1405) is a selection signal supplied to the Y driver 14. "H" of the YDATA (1405) corresponds to line selection and "L" corresponds to non-selection. The selection signal YDATA (1405) turns to "H" from the rise edge of the reset signal RES to the rise edge of the next reference clock DCLK. After that, the selection signal YDATA (1405) turns to "H" each time 240 pulses of the reference clock DCLK are outputted. The Y driver 14 takes in the selection signal YDATA with the fall edge of the reference clock DCLK and transfers the selection signal YDATA by the 240-step shift register (not shown) in the Y driver 14. Outputs of respective registers of the 240-step shift register are issued as the signals 1406–1411 and provide data supplied to 240 terminals of the Y driver 14. The outputs of the respective registers are each converted into a voltage required for displaying data on liquid crystals, and are then supplied to the LCD panel 161 for driving the LCD panel 161. The data of the signal Y0 (1406) is supplied to an uppermost terminal of the LCD panel 161 after being converted into a voltage required for displaying data on liquid crystals, and the data of the signal Y1 (1407) is supplied to another terminal positioned adjacently under the uppermost terminal. Likewise, the data of the signal Y2 (1408) is supplied to still another terminal positioned adjacently under the second uppermost terminal. In other words, one of the 240 lines of common electrodes is selected each time, and the selected electrode is scanned downward from the uppermost electrode.

The display address 1305 of the display RAM 131 includes addresses assigned with "0"–"239" from an upper end to a lower end. As shown in FIG. 1, data "□", "○" and "Δ" are written by the MPU 11 in the memory area 1301 throughout the display addresses "0"–"239". More specifically, data "□" is written throughout the display addresses "0"–"79", data "○" is written throughout the display addresses "80"–"159", and data "Δ" is written throughout the display addresses "160"–"239". Those display data are each symbolically indicated, taking into account that a dot in the memory area 301 where "1" has been written is displayed black and a dot therein where "0" has been written is displayed white. In fact, the display data is electrically written in the memory area 1301.

When any display address is inputted, the display RAM 131 supplies 320 bits of the display data at the inputted address to the X driver 32. By incrementing the display address from "0" to "239" one by one in synch with the reference clock DCLK, therefore, the display data is displayed in sequence. Specifically, since the X driver 32 takes in the data at a fall of the reference clock and outputs the taken-in data after converting a voltage, the data at the display address "0" is outputted to the segment electrodes for display when the uppermost one of the common electrodes is selected by the Y driver 14, and the data at the display address "1" is outputted to the segment electrodes for display when the second uppermost one of the common electrodes is selected by the Y driver 14.

This embodiment represents a method of variously changing data to count the display address such that fixed display areas are held in the upper and lower sides of a display screen while a display area between them is scrolled. For example, in this embodiment, display of the data "□" and "Δ" is not scrolled (fixed display), whereas display of only the data "○" is scrolled. Note that the display address "0"–"79", for example, at which the display data "□" is written, is referred to as an upper fixed display area, and the display address "160"–"239", for example, at which the display data "Δ" is written, is referred to as a lower fixed display area.

In FIG. 7, a signal 401 is a reset signal RES. A signal 402 is a reference clock DCLK supplied from the oscillator 12. A signal 414 is an output of the counter 501. A signal 415 is an output of the EXN 517. A signal 416 is an output of the D-FF 521. A signal 417 is a coincidence-detected output between the counter 501 and the register 504. A signal 418 is an input applied to the select terminal S of the selector 511. A signal 419 is an output of the counter 502. A signal 420 is a coincidence-detected output between the counter 502 and the register 507. A signal 421 is a coincidence-detected output between the counter 510 and the register 508. A signal 422 is an output of the counter 503. A signal 423 is a coincidence-detected output between the counter 503 and the fixed address "239". A signal 424 is an input applied to the select terminal S of the selector 512. A signal 425 is an input applied to the select terminal S of the selector 513. A signal 426 is an address count output applied to the display address 1305.

With the rise edge of the reset signal RES (401), the counter 501 is set to "0" and outputs "0". The counters 502, 503 and the counter 510 are reset and output "0". Further, "L" is applied to the terminals S of the selectors 512, 513 through the RSFFs 515, whereupon the selectors 512, 513 select the data A. Since the selectors 2, 3 select the data A, "0" that is the output of the counter 501 is issued as the address count output 525. The address count output 525 is supplied to the display address 1305 of the display RAM 131 shown in FIG. 1 for selecting the display address.

Any desired addresses indicating the scroll area, the fixed display areas and the number of display lines are written in the registers 504–509 from the MPU 11 through the MPU logic circuit 133. More specifically, the last one of the display addresses of the upper fixed display area in which "□" is written, i.e., "79", is written in the register 504. Among the display addresses "80"–"159" of the scroll area in which "○" is written, the scrolling start address "120" that is to be displayed at the head of the scroll area is written in the register 505. A result "80" of adding "1" to the last one "79" of the display addresses of the fixed display area, in which "□" is written, by the display logic circuit 133 is written in the register 506. The last one of the display addresses of the scroll area in which "○" is written, i.e., "159", is written in the register 507. A result "159" of subtracting "1" from "160", which is obtained by subtracting "80" corresponding to the number of display lines for the display addresses of the lower fixed display area, where "Δ" is written, from "240" corresponding to the total number of display lines, is written in the register 508. The head one of the display addresses of the lower fixed display area in which "Δ" is written, i.e., "160", is written in the register 509.

The counter 501 counts up the address number with the rise edge of the reference clock DCLK supplied from the oscillator 12. Upon the counter 501 counting up to "79", because the count coincides with the last address "79" of the upper fixed display area which is stored in the register 504, the coincidence detecting circuit 514 detects a coincidence and outputs "H" for a half-clock period from the next rise edge of the reference clock DCLK to the fall edge.

The operation of the coincidence detecting circuit 514 will now be described.

The EXN 517 outputs "H" when two input signals coincide with each other. The 4-input AND circuit 518 outputs "H" when all four input signals assume "H". The 2-input AND circuit 519 outputs "H" when all two input signals assume "H". Because there are eight EXNs 517, "H" is issued as the 8-bit comparison output 522 when a perfect coincidence occurs in all bits of 8-bit data. As indicated by the 8-bit comparison output 415 in FIG. 7, the 8-bit comparison output 522 assumes "H" in match with the period during which the 8-bit counter 501 issues the output signal of "79". The 8-bit comparison output 522 is latched by the D-FF 521 upon the reference clock DCLK that is obtained by inverting the reference clock DCLK through the inverter 520, and an output of the D-FF 521 is delayed a half clock as indicated by the D-FF output 416. The logical product of the output signal of the D-FF 521 and the reference clock is taken by the AND circuit 519. As a result, the output signal 524 of the coincidence detection assumes "H" for a half clock succeeding to the address at which the coincidence has occurred.

When the output signal of the counter 501 takes "79" and the coincidence detecting circuit 514*a* outputs an "H" pulse, "L" is applied to the terminal S of the selector 511 through the RSFF 515*a*, causing the selector 511 to select the data A. The data A is outputted from the register 505, and the scrolling start address "120" is inputted to the counter 502 through the selector 511. Since the output of the coincidence detecting circuit 514*a* is connected to the set terminal S of the counter 502 through the OR gate 516*a*, the "H" pulse outputted from the coincidence detecting circuit 514*a* is applied to the set terminal S of the counter 502, and the scrolling start address "120" is set in the counter 502. The "H" pulse outputted from the coincidence detecting circuit 514*a* is also applied to the terminal S of the selector 512 through the RSFF 515*b*, causing the selector 512 to select the data B. Accordingly, the output "120" of the counter 502 is issued to the address count output 525 through the selectors 512, 513.

When the counter 502 counts up the address number with the rise edge of the reference clock DCLK and the count reaches "159", the coincidence detecting circuit 514*b* detects a coincidence and outputs an "H" pulse because the count coincides with the last address "159" of the scroll area which is stored in the register 507. With the outputted "H" pulse, "H" is applied to the terminal S of the selector 511, causing the selector 511 to select the data B. The data B is connected to an output of the register 506 in which is written "80" that is resulted from adding "1" to the last address "79" of the upper fixed display area by the display logic circuit 133, and therefore "80" is inputted to the counter 502. Since the output of the coincidence detecting circuit 514*b* is connected to the set terminal S of the counter 502 through the OR gate 516*a*, the "H" pulse outputted from the coincidence detecting circuit 514*b* is applied to the set terminal S of the counter 502, and "80" is set in the counter 502.

Subsequently, the counter 502 continues count-up with the rise edge of the reference clock DCLK. In parallel, the counter 510 also counts up the address number with the rise edge of the reference clock DCLK. Upon the counter 510 counting up to "159", the coincidence detecting circuit 514*c* detects a coincidence and outputs an "H" pulse because the count coincides with "159" stored in the register 508. The counter 503 is connected to an output of the register 509 in which is written the head address "160" of the lower fixed display area, and therefore "160" is inputted to the counter 503. Since the output of the coincidence detecting circuit 514*c* is connected to the set terminal S of the counter 503, the "H" pulse outputted from the coincidence detecting circuit 514*c* is applied to the set terminal S of the counter 503, and "160" is set in the counter 503. The "H" pulse outputted from the coincidence detecting circuit 514*c* is also applied to the terminal S of the selector 513 through the RSFF 515*c*, causing the selector 513 to select the data B. Accordingly, "160" is issued to the address count output 525.

Further, when the counter 503 counts up the address number with the rise edge of the reference clock DCLK and the count reaches "239", the coincidence detecting circuit 514*d* detects a coincidence and outputs an "H" pulse because the count coincides with "239" given as the fixed address. The outputted "H" pulse becomes the reset signal RES through the OR gate 516*b*, whereby the setting is returned to the initial state. Then, the address count is repeated successively so long as the reference clock DCLK is applied.

As a result, as indicated by the address count output 426, the addresses are issued to the address count output 525 in the sequence of "0" to "79", "120" to "159", "80" to "119", and "160" to "239" starting from the reset signal RES. At this time, because the Y driver 14 selects the common electrode from the upper most line of the LCD panel 161 in a line-at-a-time scheme starting from the reset signal RES, the data is displayed such that "○" in the scroll display area is inverted between an upper half and a lower half, as represented in the LCD panel 161.

Scrolling can be executed by changing the data in the register 505 that stores the scrolling start address, which is to be displayed at the head of the scroll area, among the display addresses "80"–"159" of the scroll area where "○" is written. For example, if "90" is written in the register 505, the addresses are outputted in the sequence of "0" to "79", "90" to "159", "80" to "89", and "160" to "239" starting from the reset signal RES. Also, if "80" is written in the register 505, the addresses are outputted in the sequence of "0" to "79", "80" to "159" and "160" to "239" starting from the reset signal RES. Consequently, when "0" is written in the register 505, the data is displayed as represented in the LCD panel 162 in FIG. 1.

Stated otherwise, since the sequence of addresses ranging from "0" to "79" and from "160" to "239" is not changed, the data can be fixedly displayed in the areas corresponding to those addresses, while display only in the scroll area is changeable. Thus, the MPU 11 can scroll only a part of the screen vertically just by writing, in the register 505, the display address of the head line from which scrolling is to be started, with no need of rewriting the display data in the display RAM 131.

The scroll display area is freely variable by changing the data written in the register 504 and the registers 506–509. Also, while the input data "0" to the counter 501 and the input data "239" to the counter 503 are described as being fixed values, any other address may also be set by supplying input data of another value from another not-shown register. Further, the present invention can also be easily implemented in a similar manner as with the above-described embodiment, for example, in the case of displaying data fixedly in the upper fixed display area and scrolling data in all the other area including the scroll area and the lower fixed display area, or in the case of displaying data fixedly in the lower fixed display area and scrolling data in all the other area including the upper fixed display area and the scroll area. In addition, it is possible to vertically divide a screen into any desired number of areas and to perform scrolling in any of the areas similarly to the above-described embodiment by adding any desired number of registers similar to the registers 504–509, counters, etc. in FIG. 4 and inputting any desired addresses to the registers.

Second Embodiment

A second embodiment will be described with reference to the drawings.

Figure 8:
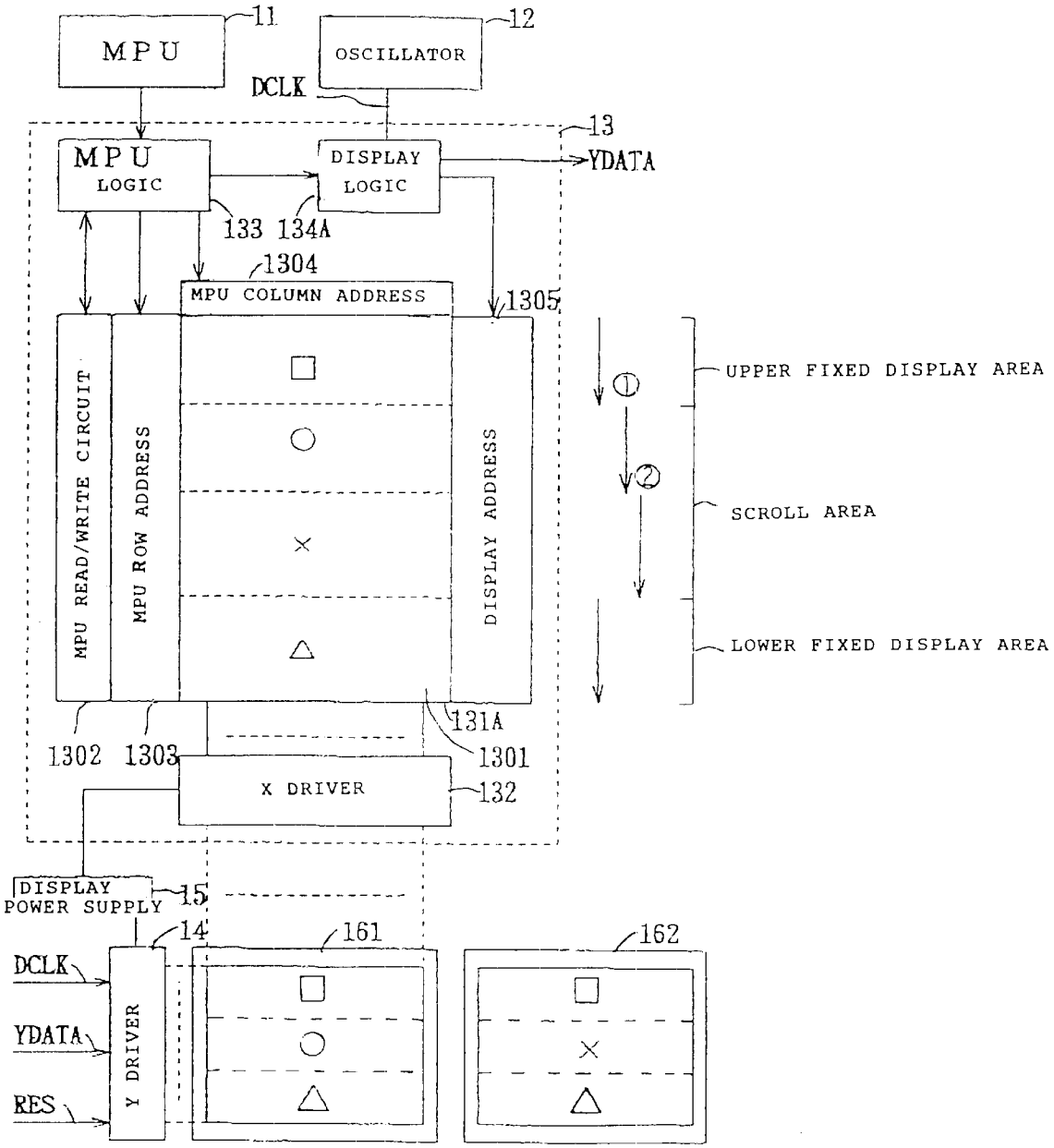
FIG. 8 is a block diagram of an image display system according to a second embodiment of the present invention.

FIG. 8 is a block diagram of an image display system in accordance with a second embodiment of the present invention. In FIG. 8, common elements to those of the embodiment shown in FIG. 1 are denoted by common symbols.

The image display system of this embodiment includes, instead of the display RAM 131 and the display logic 134 in FIG. 1, a RAM 131A having a larger storage capacity (e.g., capacity of 320×320 bits) and a display logic 134A having a different construction. Because the storage capacity of the LCD panel 161 is 240×320 dots, the RAM 131A has a storage capacity greater than that necessary for displaying a fill screen image. The display address 1305 of the display RAM 131A includes 320 addresses assigned with "0"–"319" from an upper end to a lower end. As shown in FIG. 1, data "□", "○", "x" and "Δ" are written by the MPU 11 in the memory area 1301 throughout the display addresses "0"–"319". More specifically, data "□" is written throughout the display addresses "0"–"79", data "○" is written throughout the display addresses "80"–"159", data "x" is written throughout the display addresses "160"–"239", and data "Δ" is written throughout the display addresses "240"–"319". In the display logic 134A, input data "319" is set instead of the input data "239" that is applied to one input terminal of the coincidence detecting circuit 514*d* in FIG. 4 showing the first embodiment. The other construction is the same as shown in FIG. 1.

Figure 9:
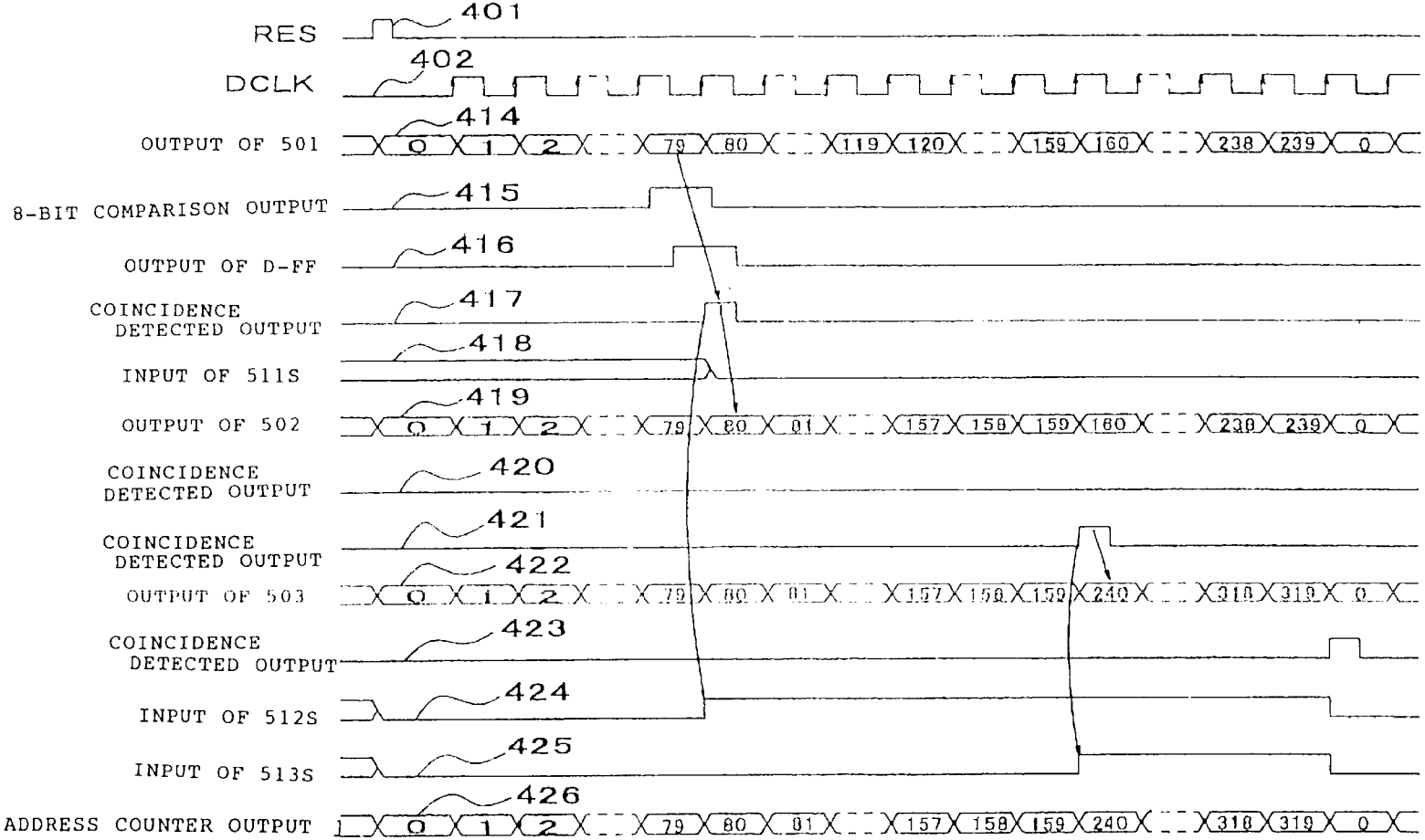
FIG. 9 is a time chart for FIG. 8.

FIG. 9 is a time chart of signals at respective points for explaining the operation of FIG. 8. In FIG. 9, the vertical axis represents a logical level and the horizontal axis represents time. The operation of the image display system of FIG. 8 will be described below with reference to FIG. 9.

Although the basic operation is the same as described above in connection with FIG. 7, count data at each of the output 414 of the counter 501, the output 419 of the counter 502, and the output 422 of the counter 502 is different. More specifically, any desired addresses indicating the scroll area, the fixed display areas and the number of display lines are written in the registers 504–509. The last one of the display addresses of the upper fixed display area in which "□" is written, i.e., "79", is written in the register 504. Among the display addresses "80"–"239" of the scroll area in which "○" and "x" are written, the scrolling start address "80" that is to be displayed at the head of the scroll area is written in the register 505. A result "80" of adding "1" to the last one "79" of the display addresses of the fixed display area, in which "□" is written, by the display logic circuit 33 is written in the register 506. The last one of the display addresses of the scroll area in which "○" and "x" are written, i.e., "159", is written in the register 507. A result "159" of subtracting "1" from "160", which is obtained by subtracting "80" corresponding to the number of display lines for the display addresses of the lower fixed display area, where "Δ" is written, from "240" corresponding to the total number of display lines, is written in the register 508. The head one of the display addresses of the lower fixed display area in which "Δ" is written, i.e., "240", is written in the register 509.

The circuit operates in a similar manner as with the first embodiment under the above-described setting. As a result, as indicated by the address count output 426 in FIG. 9, the address count output 525 provided to the display address 1305 issues the addresses in the sequence of "0" to "79", "80" to "159", and "240" to "319" starting from the reset signal RES. At this time, because the Y driver 14 selects the common electrode from the upper most line of the LCD panel 161 in a line-at-a-time scheme starting from the reset signal RES, only "○" of "○" and "x" in the scroll display area is displayed and "x" is not displayed, as represented in the LCD panel 161.

Scrolling can be executed by changing the data in the register 505 that stores the scrolling start address, which is to be displayed at the head of the scroll area, among the display addresses "80"–"239" of the scroll area where "○" and "x" are written. For example, if "160" is written in the register 505, the addresses are outputted in the sequence of "0" to "79", "160" to "239", and "240" to "319" starting from the reset signal RES. Consequently, when "0" is written in the register 505, the data is displayed as represented in the LCD panel 162 in FIG. 8. Stated otherwise, since an extra memory is provided, the display data that has not been displayed so far can be displayed as soon as the data is scrolled, and therefore smooth scrolling can be achieved. If there is no extra memory, this means that the position of the same data is simply moved in the scroll area. In the case of, for example, desiring to display new data at the same time as scrolling, data in the display RAM 131 must be rewritten one after another each time the data is scrolled. However, the rewriting and the scrolling cannot be performed at the same time, and the rewriting must be made on the data being displayed. Accordingly, the scrolling cannot be smoothly performed depending on the speed and timing of the rewriting executed by the MPU 11.

The scroll display area is freely variable by changing the data written in the register 504 and the registers 506–509. Also, while the input data "000" to the counter 501 and the input data "319" to the counter 503 are described as being fixed values, any other address may also be set by supplying input data of another value from another not-shown register. Further, the present invention can also be easily implemented in a similar manner as with the above-described embodiment in the case of scrolling data in all the other areas except for the upper fixed display area, or in the case of scrolling data in all the other areas except for the lower fixed display area. Moreover, while the embodiments described above are implemented by the addressing method in which the Y driver 14 selects one line at a time, another addressing method of selecting plural lines at a time can also be easily realized in accordance with the present invention based on the similar intent.

In addition, as with the first embodiment, it is possible to vertically divide a screen into any desired number of areas and to perform scrolling in any of the areas similarly to the above-described embodiment by adding any desired number of registers similar to the registers 504–509, counters, etc. and inputting any desired addresses to the registers.

Third Embodiment

A third embodiment will be described with reference to the drawings.

Figure 10:
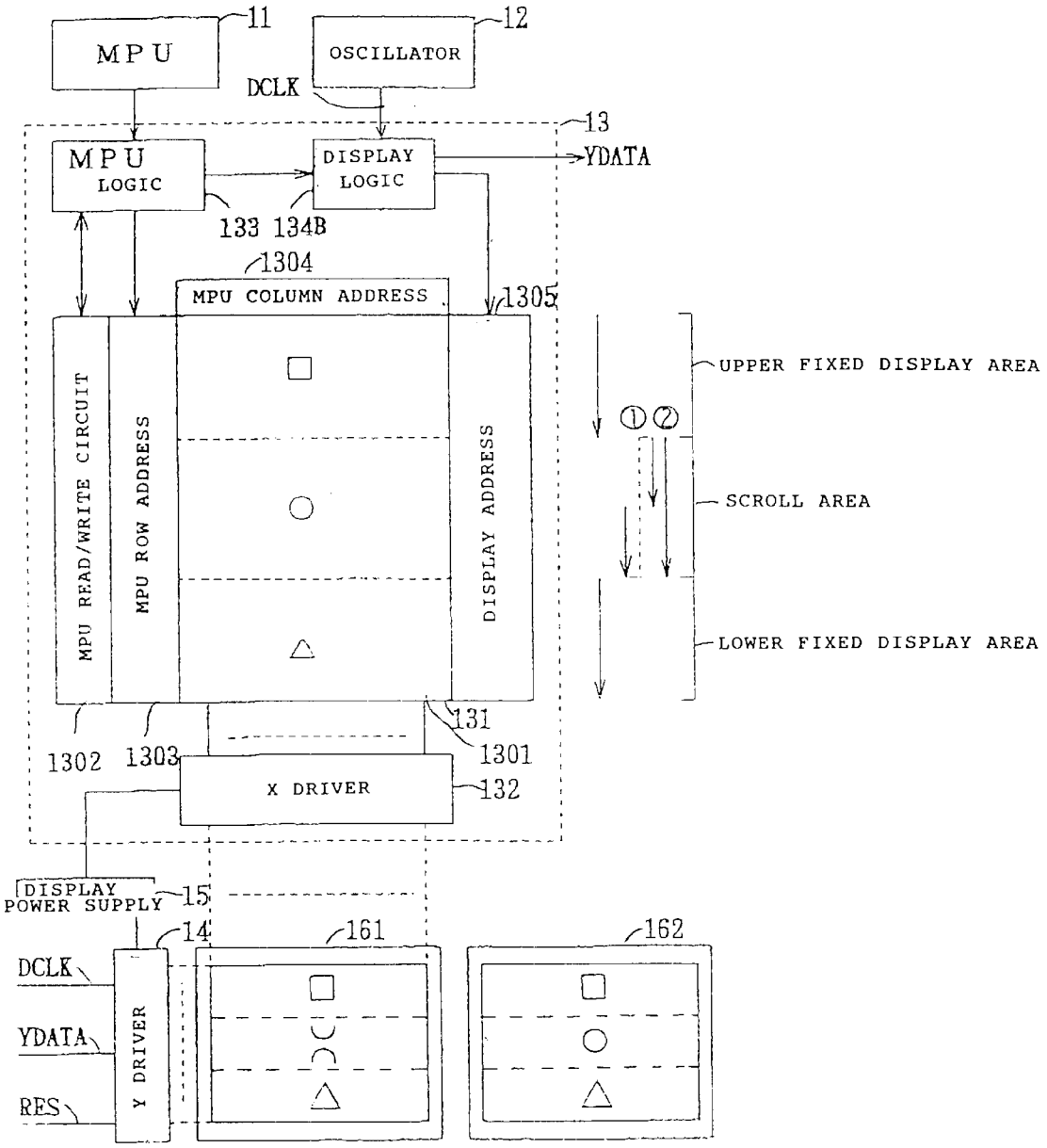
FIG. 10 shows an image display system according to a third embodiment of the present invention.

FIG. 10 is a block diagram of an image display system in accordance with a third embodiment of the present invention. In FIG. 10, common elements to those of the embodiment shown in FIG. 1 are denoted by common symbols.

The image display system of this third embodiment includes, instead of the display logic 134 in FIG. 1, a display logic 134B having a different construction. The other construction is the same as shown in FIG. 1.

Figure 11:
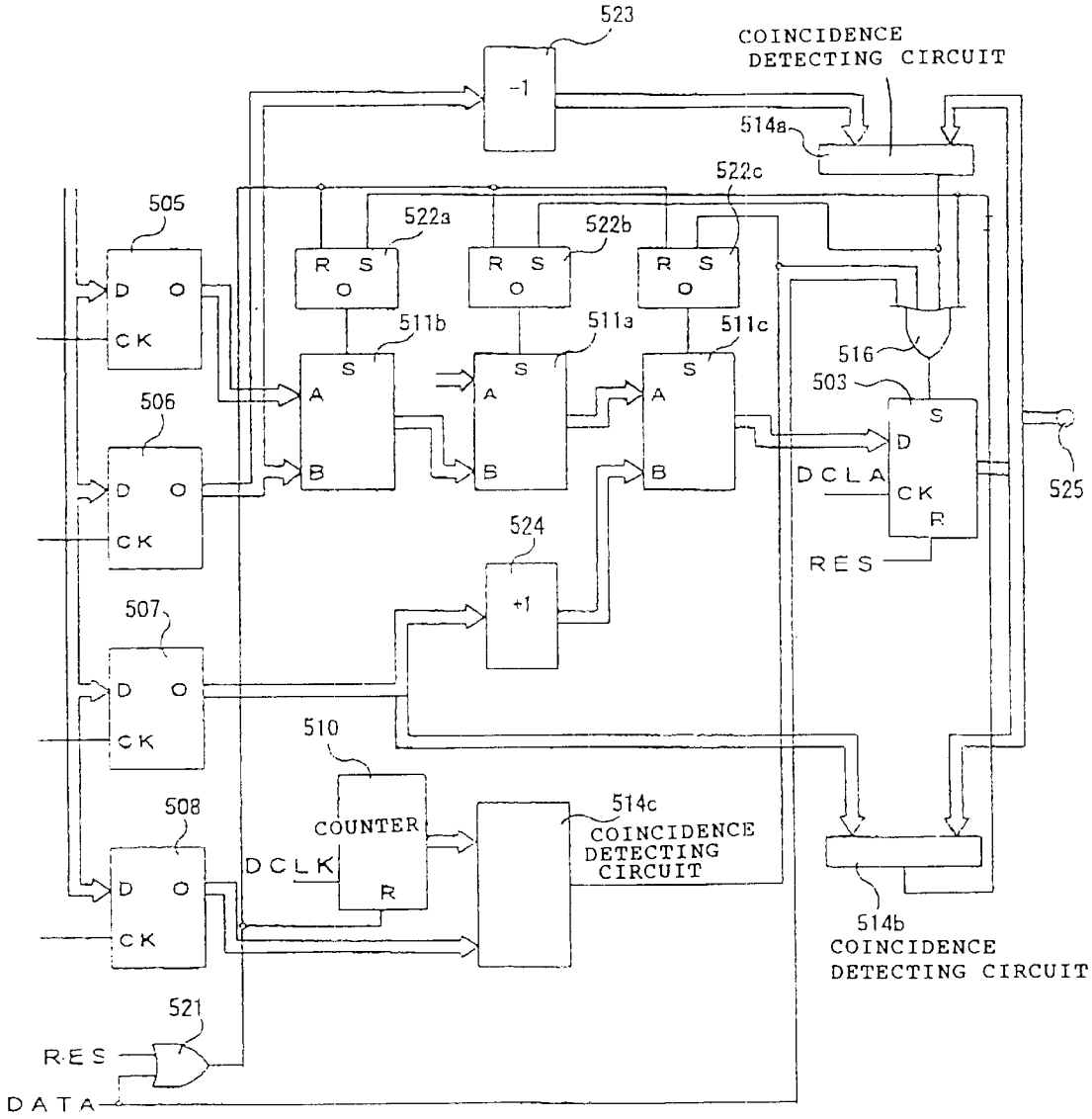
FIG. 11 is a circuit diagram of a display logic 134B in FIG. 10.

FIG. 11 is a circuit diagram of a principal part of the display logic 134B in FIG. 10. In FIG. 11, common elements to those in FIG. 4 are denoted by common symbols.

The display logic 134B includes a register 505 for storing the scrolling start address (e.g., "120"), a register 506 for storing the head address (e.g., "80") of the scroll area, a register 507 for storing the last address (e.g., "159") of the scroll area, and a register 508. A result "159" of subtracting "1" from "160", which is obtained by subtracting "80" corresponding to the number of display lines for the display addresses of the lower fixed display area, where "Δ" is written, from "240" corresponding to the total number of display lines, is written in the register 508. The register 505 is connected to an input terminal A of a selector 511*b*, and the register 506 is connected to an input terminal B of the selector 511*b*. Also, the register 506 is connected to a decrement circuit (circuit for subtracting one) 523, and the decrement circuit 523 is connected to one input terminal of a coincidence detecting circuit 514*a*. The register 507 is connected to an increment circuit (circuit for adding one) 524 and to one input terminal of a coincidence detecting circuit 514*b*. The register 508 is connected to one input terminal of a coincidence detecting circuit 514*c*. A reset signal RES and a signal DATA are applied to an OR circuit 521. An output terminal of the OR circuit 521 is connected to a reset terminal R of a counter 510 for counting a reference clock DCLK, and to terminals R of RSFFs 522*a*, 522*b* and 522*c*. An output terminal of the counter 510 is connected to the other input terminal of the coincidence detecting circuit 514*c*. An output terminal of the coincidence detecting circuit 514*c* is connected to a terminal S of the RSFF 522*c* and to a first input terminal of an OR circuit 516.

Also, the signal DATA is applied to a second input terminal of the OR circuit 516. An output terminal of the coincidence detecting circuit 514*a* is connected to a third input terminal of an OR circuit 516 and to a terminal S of the RSFF 522*b*. A terminal S of the selector 511*b* is connected to an output terminal of the RSFF 522*a*. An output terminal of the selector 511*b* is connected to an input terminal B of a selector 511*a*, and data "000" is applied to an input terminal A of the selector 511*a*. A terminal S of the selector 511*a* is connected to an output terminal of the RSFF 522*b*. An output terminal of the selector 511*a* is connected to an input terminal A of a selector 511*c*, and an output terminal of the increment circuit 524 is connected to an input terminal B of the selector 511*c*. An output terminal of the selector 511*c* is connected to an input terminal D of the counter 503, and the reference clock DCLK is applied to a clock input terminal CK of the counter 503. The reset signal RES is applied to a reset terminal R of the counter 503. An output terminal of the counter 503 is connected to the other input terminal of the coincidence detecting circuit 514*a* and to the other input terminal of the coincidence detecting circuit 514*b*. An address count output 525 is issued from the output terminal of the counter 503. An output terminal of the coincidence detecting circuit 514*b* is connected to a fourth input terminal of the OR circuit 516 and to a terminal S of the RSFF 522*a*.

Figure 12:
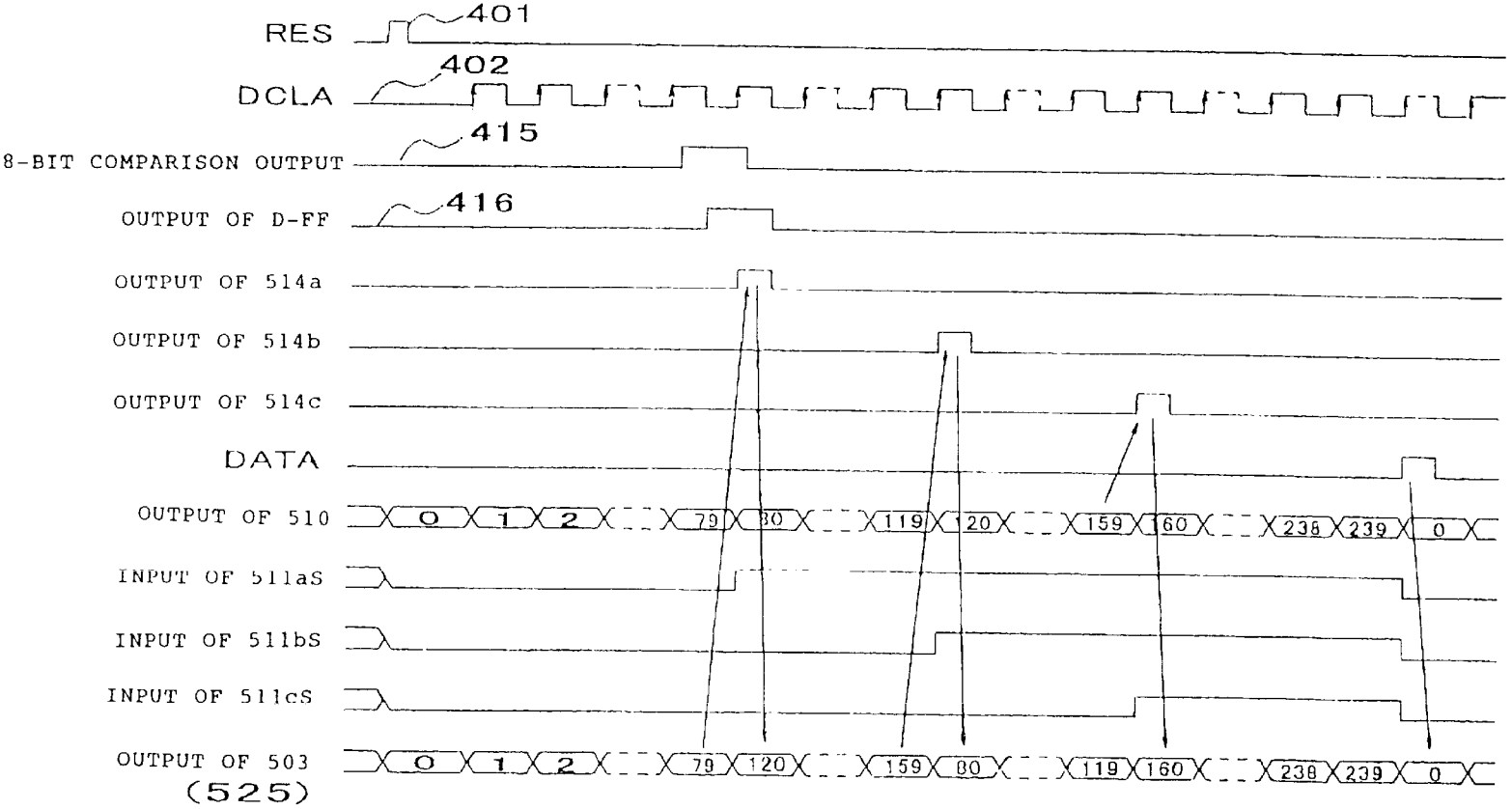
FIG. 12 is a time chart for FIG. 11.

FIG. 12 is a time chart of signals at respective points for explaining the operation of the image display system of FIG. 11.

In the image display system of this embodiment, the scrolling start address "120" is written in the register 505, the head address "80" of the scroll area is written in the register 506, the last address "159" of the scroll area is written in the register 507, and a result "159" of subtracting "1" from "160", which is obtained by subtracting "80" corresponding to the number of display lines for the display addresses of the lower fixed display area, where "Δ" is written, from "240" corresponding to the total number of display lines, is written in the register 508. Then, substantially the same operation as in the first embodiment is performed by the display logic 134B which has a simpler construction than the display logic 134 shown in FIG. 4.

As described above, when the semiconductor device of the present invention is employed in electronic systems such as electronic notepads and cellular phones, for example, the MPU 11 can scroll only a part of the screen just by writing, in a register, the display address of the head line from which scrolling is to be started, without rewriting the display data in the display RAM 131, by performing initial setting of a scroll area and a fixed display area. Therefore, the number of accesses made from the MPU 11 to the display RAM 131 is much lessened and power consumption in the scrolling mode can be greatly reduced in comparison with the case of rewriting the display data in the scroll area. Additionally, by preparing a memory that has a larger capacity than required for displaying a full screen image, the display data including new data can be smoothly scrolled. Further, if another processing is interrupted in the MPU 11 during rewriting of the display data in the display RAM 131, the display data in the course of the rewriting appears on the screen in the conventional system wherein the display data is scrolled after the rewriting, but such a trouble can be avoided in the present invention.

What is claimed is:

1. A semiconductor device, comprising:

a memory for storing display data;

a voltage converting unit for converting a logical voltage based on said display data into a driving voltage for driving a display device, said display data being read out of said memory in accordance with a reference clock, said driving voltage being converted corresponding to the read-out display data and being supplied to said display device;

a counting unit for counting an address of said memory; and registers for storing any desired addresses;

wherein the sequence of reading the display data stored in said memory is optionally set in accordance with the contents of said registers.

2. A semiconductor device according to claim 1, wherein said memory has a memory capacity larger than that for the display data corresponding to the number of pixels of said display device.

3. A semiconductor device according to claim 1, wherein after counting up from a first fixed address to an address stored in a first register, counting is performed from an address stored in a second register to an address stored in a third register.

4. A semiconductor device according to claim 1, wherein after counting up from an address stored in a first register to an address stored in a second register, counting is performed from an address stored in a third register to a second fixed address.

5. A semiconductor device according to claim 1, wherein after counting up from a first fixed address to an address stored in a first register, counting is performed from an address stored in a second register by a predetermined number of counts, and thereafter counting is performed from an address stored in a third register to a second fixed address.

6. A semiconductor device according to claim 1, wherein said display device is a line-at-a-time scanning-type liquid crystal display.

7. An electronic system, comprising:

a semiconductor device comprising a memory for storing display data;

a voltage converting unit for converting a logical voltage based on said display data into a driving voltage for driving a display device, said display data being read out of said memory in accordance with a reference clock, said driving voltage being converted corresponding to the read-out display data and being supplied to said display device;

a counting unit for counting an address of said memory; and registers for storing any desired addresses;

wherein the sequence of reading the display data stored in said memory is optionally set in accordance with the contents of said registers.

8. An image display system, comprising:

a semiconductor device comprising a memory for storing display data, wherein the display data correspond to an image, a voltage converting unit for converting a logical voltage based on said display data into a driving voltage for driving a display device, said display data being read out of said memory in accordance with a reference clock, said driving voltage being converted corresponding to the read-out display data and being supplied to said display device, a counting unit for counting an address of said memory, and registers for storing any desired addresses, wherein the sequence of reading the display data stored in said memory is optionally set in accordance with the contents of said registers; and a display device for receiving said driving voltage and displaying the image corresponding to said display data.

9. An electronic system, comprising:

an image display system comprising a semiconductor device comprising a memory for storing display data, wherein the display data correspond to an image, a voltage converting unit for converting a logical voltage based on said display data into a driving voltage for driving a display device, said display data being read out of said memory in accordance with a reference clock, said driving voltage being converted corresponding to the read-out display data and being supplied to said display device, a counting unit for counting an address of said memory, and registers for storing any desired addresses, wherein the sequence of reading the display data stored in said memory is optionally set in accordance with the contents of said registers; and a display device for receiving said driving voltage and displaying the image corresponding to said display data.

10. A semiconductor device, comprising:

a memory for storing display data;

a display controller for reading said display data out of said memory in accordance with a reference clock, wherein said display controller comprises a counting unit for counting an address of said memory; and registers for storing specified addresses; and a voltage converting unit for converting a logical voltage based on the supplied display data into a driving voltage for driving a display device and supplying the driving voltage to said display device, wherein the display controller directly supplies the read-out display data to the voltage converting unit, wherein the sequence of reading the display data stored in said memory is optionally set in accordance with the contents of said registers.

11. A semiconductor device according to claim 10, wherein said memory has a memory capacity larger than that for the display data corresponding to the number of pixels of said display device.

12. A semiconductor device according to claim 10, wherein after counting up from a first fixed address to an address stored in a first register, counting is performed from an address stored in a second register to an address stored in a third register.

13. A semiconductor device according to claim 10, wherein after counting up from an address stored in a fast register to an address stored in a second register, counting is performed from an address stored in a third register to a second fixed address.

14. A semiconductor device according to claim 10, wherein after counting up from a first fixed address to an address stored in a first register, counting is performed from an address stored in a second register by a predetermined number of counts, and thereafter counting is performed from an address stored in a third register to a second fixed address.

15. A semiconductor device according to claim 10, wherein said display device is a line-at-a-time scanning-type liquid crystal display.

16. An electronic system, comprising:

a semiconductor device comprising a memory for storing display data;

a display controller for reading said display data out of said memory in accordance with a reference clock, wherein said display controller comprises a counting unit for counting an address of said memory; and registers for storing specified addresses; and a voltage converting unit for converting a logical voltage based on the supplied display data into a driving voltage for driving a display device and supplying the driving voltage to said display device, wherein the display controller supplies the read-out display data to the voltage converting unit, wherein the sequence of reading the display data stored in said memory is optionally set in accordance with the contents of said registers.

17. An image display system, comprising:

a semiconductor device, comprising:

a memory for storing display data, wherein the display data correspond to an image;

a display controller for reading said display data out of said memory in accordance with a reference clock, wherein said display controller comprises a counting unit for counting an address of said memory; and registers for storing specified addresses; and a voltage converting unit for converting a logical voltage based on the supplied display data into a driving voltage for driving a display device and supplying the driving voltage to said display device, wherein the display controller supplies the read-out display data to the voltage converting unit, wherein the sequence of reading the display data stored in said memory is optionally set in accordance with the contents of said registers; and a display device for receiving said driving voltage and displaying the image corresponding to said display data.

18. An electronic system, comprising:

an image display system comprising a semiconductor device comprising a memory for storing display data, wherein the display data correspond to an image;

a display controller for reading said display data out of said memory in accordance with a reference clock, wherein said display controller comprises a counting unit for counting an address of said memory; and registers for storing specified addresses; and a voltage converting unit for converting a logical voltage based on the supplied display data into a driving voltage for driving a display device and supplying the driving voltage to said display device, wherein the display controller supplies the read-out display data to the voltage converting unit, wherein the sequence of reading the display data stored in said memory is optionally set in accordance with the contents of said registers; and a display device for receiving said driving voltage and displaying the image corresponding to said display data.

* * * * *